US006957537B2

(12) United States Patent
Hirasaki

(10) Patent No.: US 6,957,537 B2
(45) Date of Patent: Oct. 25, 2005

(54) COMBUSTOR OF A GAS TURBINE HAVING A NOZZLE PIPE STAND

(75) Inventor: Takeo Hirasaki, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/490,386

(22) PCT Filed: Apr. 15, 2003

(86) PCT No.: PCT/JP03/04788

§ 371 (c)(1),
(2), (4) Date: Apr. 2, 2004

(87) PCT Pub. No.: WO03/087559

PCT Pub. Date: Oct. 23, 2003

(65) Prior Publication Data

US 2004/0237531 A1 Dec. 2, 2004

(30) Foreign Application Priority Data

Apr. 15, 2002 (JP) ..... 2002-112630

(51) Int. Cl.[7] ..... F02C 1/00; F02G 3/00
(52) U.S. Cl. ..... 60/746; 60/796; 60/734
(58) Field of Search ..... 60/796, 798, 804, 60/734, 737, 739, 740, 39.37, 746, 747, 39.463

(56) References Cited

U.S. PATENT DOCUMENTS

| | | | | |
|---|---|---|---|---|
| 5,277,023 A | | 1/1994 | Bradley et al. | |
| 5,361,578 A | | 11/1994 | Donlan | |
| 5,660,045 A | * | 8/1997 | Ito et al. | 60/737 |
| 5,873,237 A | * | 2/1999 | Medla et al. | 60/800 |
| 5,899,074 A | * | 5/1999 | Komatsu et al. | 60/737 |
| 5,983,642 A | * | 11/1999 | Parker et al. | 60/737 |
| 6,122,916 A | * | 9/2000 | Amos et al. | 60/747 |
| 6,149,075 A | * | 11/2000 | Moertle et al. | 239/132.3 |
| 6,216,439 B1 | | 4/2001 | Nakamoto | |
| 6,385,961 B2 | | 5/2002 | Nakamoto | |
| 6,385,975 B1 | | 5/2002 | Nakamoto | |
| 6,389,795 B1 | | 5/2002 | Nakamoto | |
| 6,393,827 B1 | | 5/2002 | Nakamoto | |
| 6,467,272 B1 | * | 10/2002 | Biondo et al. | 60/740 |
| 6,622,488 B2 | * | 9/2003 | Mansour et al. | 60/740 |
| 6,634,175 B1 | * | 10/2003 | Kawata et al. | 60/746 |
| 6,640,548 B2 | * | 11/2003 | Brushwood et al. | 60/776 |
| 6,672,073 B2 | * | 1/2004 | Wiebe | 60/796 |
| 6,722,132 B2 | * | 4/2004 | Stuttaford et al. | 60/737 |
| 6,755,024 B1 | * | 6/2004 | Mao et al. | 60/776 |
| 6,763,663 B2 | * | 7/2004 | Mansour et al. | 60/740 |
| 6,786,046 B2 | * | 9/2004 | Wiebe et al. | 60/737 |
| 6,813,890 B2 | * | 11/2004 | Martling et al. | 60/737 |
| 2002/0134084 A1 | * | 9/2002 | Mansour et al. | 60/740 |
| 2003/0024249 A1 | * | 2/2003 | Akagi et al. | 60/740 |
| 2004/0129001 A1 | * | 7/2004 | Lehtinen | 60/740 |
| 2004/0148937 A1 | * | 8/2004 | Mancini | 60/740 |
| 2004/0177615 A1 | * | 9/2004 | Martling | 60/740 |

FOREIGN PATENT DOCUMENTS

| | | |
|---|---|---|
| JP | 58-122872 | 8/1983 |
| JP | 11-324722 | 11/1999 |
| JP | 2000-97435 | 4/2000 |
| JP | 2001-59427 | 3/2001 |
| JP | 2001-153364 | 6/2001 |
| WO | WO 01/40710 A1 | 6/2001 |

* cited by examiner

*Primary Examiner*—William H. Rodriguez
(74) *Attorney, Agent, or Firm*—Armstrong, Kratz, Quintos, Hanson & Brooks, LLP

(57) ABSTRACT

Manifolds are shaped cross star having curved surfaces inside thereof, and holes are bored in four corners of the manifolds. In mounting a combustor to a casing, oil in the manifolds is transmitted to the holes by way of the curved surfaces. As a result of this, oil is prevented from staying, and coking is prevented from occurring, inside the manifolds.

9 Claims, 7 Drawing Sheets

(a)

(b)

COMBUSTOR OF A GAS TURBINE HAVING A NOZZLE PIPE STAND

BACKGROUND OF THE INVENTION

1. Field of the Invention

The present invention relates to a combustor for a gas turbine that can prevent oil in a manifold from coking.

2. Description of the Related Art

The combustor for the gas turbine has a plurality of main nozzles around a pilot nozzle. A plurality of such combustors are disposed around a casing of the gas turbine. A dual-type combustor is a combustor that switches fuels from oil-fired to gas-fired. In the dual-type combustor, the pilot nozzle thereof is dually structured including a central pipe through which pilot oil-fuel flows and an outer pipe, which is provided around the central pipe, where pilot gas-fuel flows. The main nozzle is also dually structured including a central pipe for the oil-fuel and an outer pipe for the gas-fuel.

FIG. 6 is a front view of the nozzle of the combustor, and FIG. 7 is an explanatory schematic of the oil-fuel supply lines. As shown in FIG. 6, the pilot nozzle 1 is allocated in the center of the combustor 500, and eight main nozzles 2 are aligned around the pilot nozzle 1, both the pilot nozzle and main nozzles can combust the oil-fuel and the gas-fuel by switching the fuels. Among the main nozzles 2, the nozzles with hatching are main-A-nozzles 2*a*, the nozzles without the hatching are main-B-nozzles 2*b*, and 2*a* and 2*b* are alternately disposed. As shown in FIG. 2, the combustor 500 is provided with three fuel lines, which are a main-A line 501, a main-B line 502, and a pilot line 503. The fuel is supplied to each line separately.

The main-A-nozzles 2*a* and the main-B-nozzles 2*b* have an oil-fuel supply port each. However, in a midway, 2*a* and 2*b* respectively have a manifold 510 and 511, which distribute the oil-fuel to each main nozzle 2. To be more specific, as shown in FIG. 8, 2*a* and 2*b* constitute a nozzle pipe stand 515 by laying disk shaped members 512, 513, and 514. Each disk shaped member 512 to 514 forms a hole 516 in a center thereof, through which the pilot nozzle passes, and have grooves 519 and 520 formed with ring shaped protruding portions 517 and 518, which constitute the manifolds 510 and 511. The grooves 519 and 520 respectively have four holes bored through which center pipes of the main nozzles 2 pass. The disk shaped members 512 and 513, which cover the grooves 519 and 520, are provided with pipes 522 and 523 that communicatively connect an oil-fuel supply unit with the grooves 519 and 520. The disk shaped members 512 to 514 are welded and fixed in a state the disk shaped members 512 and 513 are being laid and assembled together.

In the structure mentioned above, the main-A line 501 and main-B line 502 come to possess branches in the nozzle pipe stand 515 as shown in FIG. 7. It is possible to emit the fuel from the eight main nozzles 2 ((1) to (8) in FIG. 7) by supplying the oil-fuel from a pipe A and pipe B. Emitted fuel mixes with compressed air that is sent from a compressor and burns.

A little amount of oil remains in the manifolds 510 and 511 after the gas turbine is stopped, or in the case of the dual-type combustor, after being switched from the oil-fuel to the gas-fuel. It is usually the case to discharge the remaining oil from the manifolds by taking in purging air from the pipe A and pipe B. However, as shown in FIG. 9, oil 40 remains in a lower part of the manifolds because the manifolds 510 and 511 are circular in shape. Meanwhile, temperatures of the main nozzles 2 rise, because the nozzles receive heat from the casing after the gas turbine is stopped or while the gas turbine is being operated by the oil-fuel. The remaining oil in the manifolds 510 and 511 of the nozzles 2 is heated and causes coking that results in a problem by blocking the nozzles due to a phenomenon mentioned above.

Therefore, it is an object of the present invention to provide a combustor that can prevent coking from occurring, which will otherwise occur in the manifolds that branch pipes for the oil-fuel provided to the nozzle pipe stand.

SUMMARY OF THE INVENTION

The nozzle pipe stand is mounted to the casing of the gas turbine, and the heat is conducted from the casing to the nozzle pipe stand through the mounting portion. When the temperature in the casing reaches over 400 degrees centigrade, if the heat is transmitted to the remaining oil in the manifolds, the oil readily cokes. Thus, it is possible to prevent the inside of the manifolds from reaching a high temperature by insulating the heat from the casing by means of providing the thermal insulating portion between the mounting portion to the casing and the manifolds. By this means, even if the remaining oil exists in the manifolds, it is possible to prevent the oil from coking. The thermal insulation portion can be made of either an air layer or thermal insulation materials.

It is an object of the present invention to solve at least the problems in the conventional technology.

The other objects, features, and advantages of the present invention are specifically set forth in or will become apparent from the following detailed descriptions of the invention when read in conjunction with the accompanying drawings.

DESCRIPTION OF THE PREFERRED EMBODIMENTS

Exemplary embodiments of the present invention are explained in detail below with reference to the accompanying drawings. The present invention is not limited to those embodiments. The components in the embodiments below include one that can be assumed by a person having ordinary skill in the art and one that are substantially the same as the components. Furthermore, the components in the embodiments below include one that can be assumed by a person having ordinary skill in the art.

Figure 1:
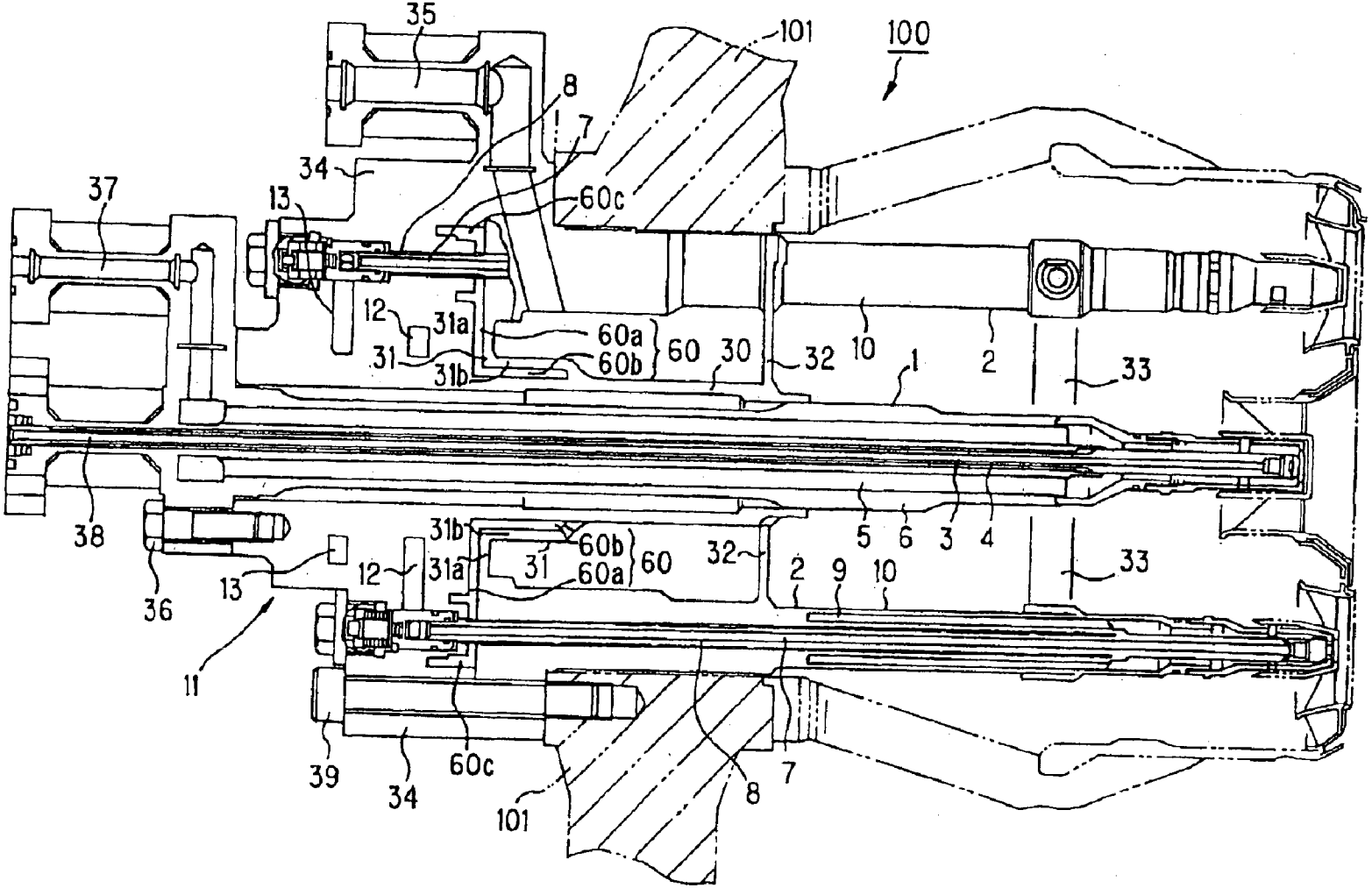
FIG. 1 is a cross section of a combustor for a gas turbine according a first embodiment of the present invention.
Figure 2:
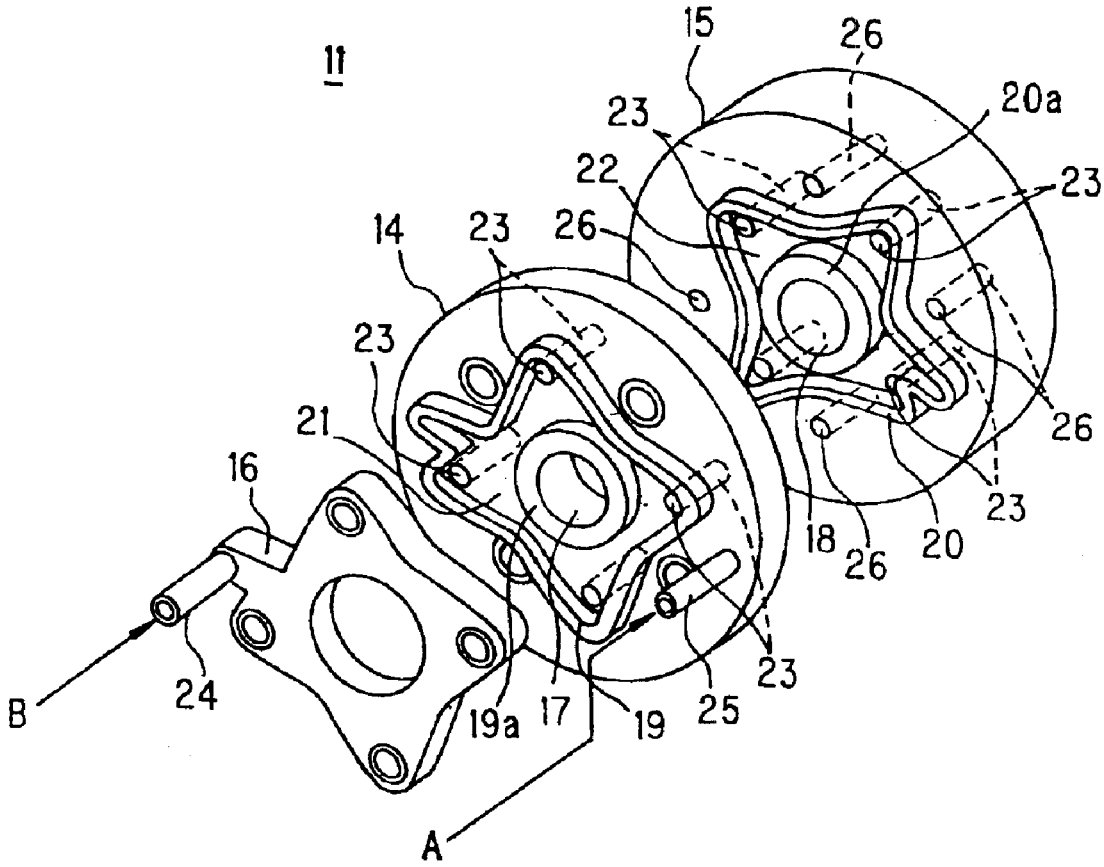
FIG. 2 is an assembly drawing of a nozzle pipe stand of the combustor shown in FIG. 1.

FIG. 1 is the cross section of the combustor according a first embodiment of the present invention. FIG. 2 is the assembly drawing of the nozzle pipe stand of the combustor shown in FIG. 1. FIGS. 3A to 3C are explanatory drawings depicting the shape of manifold of the nozzle pipe stand. A combustor 100 of this gas turbine includes a pilot nozzle 1 and a plurality of main nozzles 2 that are disposed around the pilot nozzle 1. A plurality of combustors 100 is disposed around a casing 101 in a circumferential direction. The pilot nozzle 1 is double structured including a central pipe 4 that constitutes a pilot oil-fuel passage 3 through which the pilot oil-fuel passes and an outer pipe 6 that constitutes a pilot gas-fuel passage 5 through which the pilot gas-fuel passes.

Each of a main nozzle 2 is double structured including a central pipe 8 that constitutes an oil-fuel passage 7 for supplying the oil-fuel and an outer pipe 10 that is disposed around the central pipe 8 forming a gas-fuel passage 9 between the central pipe 8 and the outer pipe 10. The oil-fuel and the gas-fuel are jetted outward from a tip of each of the main nozzle 2. A main-A-nozzle 2*a* and main-B-nozzle 2*b* of the main nozzle 2 is mounted alternately to the nozzle pipe stand 11. The nozzle pipe stand 11 includes a manifold 12 and a manifold 13 that branches the oil-fuel to the main-A-nozzle 2*a* in a main-A line and branches the oil-fuel to the main-B-nozzle 2*b* respectively.

The nozzle pipe stand 11, as shown in FIG. 2, is constituted by stacking disk shaped members 14 and 15 and lid members 16, and the disk shaped members 14 and 15 have holes 17 and 18 in a center thereof through which the pilot nozzle 1 passes. And the nozzle pipe stand 11 has concave portions 21 and 22 formed by star shaped circular convex portions 19 and 20 that constitute the manifolds 12 and 13. The concave portions 21 and 22 respectively have four holes 23 bored to let pass through central the pipes 8 of the main nozzles 2. The lid members 16 that cover the concave portions 21 and 22 are provided with pipes 24 and 25 that communicatively connect an oil-fuel supply unit (not shown) with the concave portions 21 and 22. The disk shaped members 14 and 15, and the lid members 16 are welded and fixed in a state being laid and assembled together. The star shaped manifolds 12 and 13 (refer to FIGS. 3A to 3C for cross sections) are formed consisting of the concave portions 21 and 22 in the nozzle pipe stand 11 in a state that the disk shaped members 14 and 15, and the lid members 16 are welded. Moreover, the disk shaped member 15 is provided with a hole 26 to let pass through the central pipe 8 of the main nozzle 2 in the main B line.

The main nozzle 2 is fixed to a sleeve 30 to which the pilot nozzle 1 is inserted using a mounting sleeve 31 with a flange and a spider arm 32. Moreover, the main nozzle 2 is coupled to the outer pipe 6 of the pilot nozzle 1 at the front of the pilot nozzle 1 by a spider arm 33. Furthermore, the central pipe 8 of the main nozzle 2 is fixed to the hole 23 through the hole 23 of the nozzle pipe stand 11, and an end thereof is opened to the side of manifolds 12 and 13. Moreover, the nozzle pipe stand 11 is provided with a flange 34 to mount to the casing 101. The nozzle pipe stand 11 has a compressed air inlet 35 to introduce compressed air from a compressor.

The pilot nozzle 1 is inserted from the holes 17 and 18 of the nozzle pipe stand 11 and fixed to the nozzle pipe stand 11 with a bolt 36. A rear end of the pilot nozzle 1 is provided with a gas-fuel inlet 37 through which the pilot gas-fuel is introduced and a oil-fuel inlet 38 through which the pilot oil-fuel is introduced. The nozzle pipe stand 11 is mounted to the casing 101 by fixing the flange 34 with a bolt 39.

Figure 3:
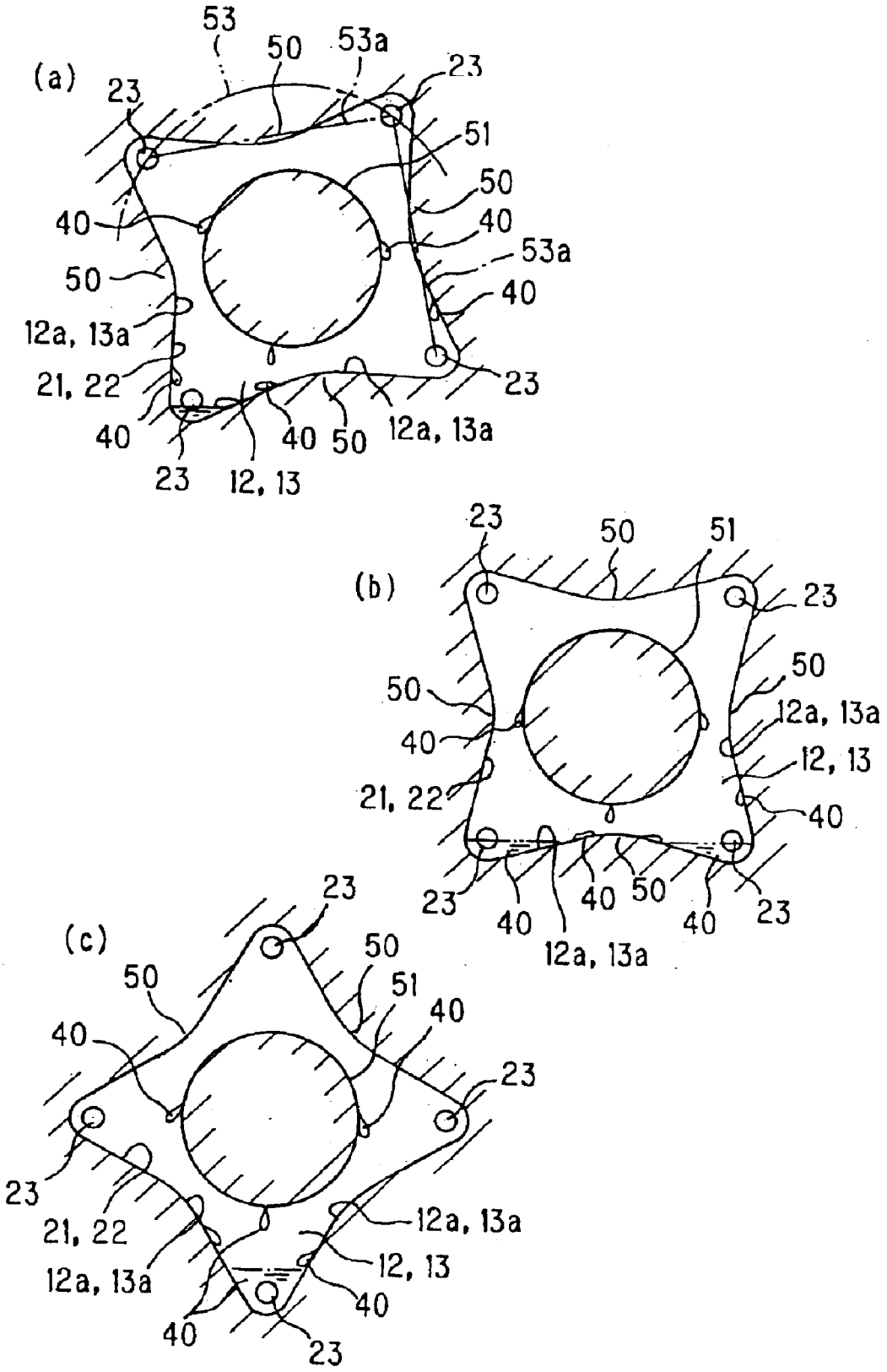
FIGS. 3A to 3C are explanatory drawings depicting a shape of manifold of the nozzle pipe stand.

According to the cross star shaped manifolds 12 and 13, as shown in FIG. 3, after the gas turbine is stopped or after being switched from the oil-fuel to gas-fuel in the dual-type combustor of the gas turbine, the oil in the manifolds 12 and 13 moves to downwards by way of curved slope 12*a* and 13*a*, and flows into the oil-fuel passage 7 of the central pipe 8 from the hole 23 of the manifolds 12 and 13. Thus it is possible to discharge the oil 40 in the manifolds 12 and 13 from the hole 23. In addition, preferably by taking purging air into the manifolds 12 and 13, it is possible to securely purge the oil 40 in the manifolds 12 and 13.

The main nozzle 2 is mounted to the casing 101 in a plurality; a mounting angle of the main nozzle is decided by the convenience of introducing the fuel and air, and the hole 23 of the manifolds is not used as a reference. Therefore, in the conventional structure, most of the holes did not come to the lowest part of the manifolds; the oil remained in the manifolds and problematically caused coking due to the heat of the casing. On the other hand, according to a structure of this embodiment, all of the main nozzles 2 are provided with the same star shaped manifolds 12 and 13. No matter what angles the manifolds 12 and 13 are mounted to, for example, even when the manifolds are angled as shown in FIGS. 3B and 3C, most part of the manifolds 12 and 13 become curved slopes 12*a* and 13*a*. The oil 40 reaches the hole 23 by way of the curved slope 12*a* and 13*a* because the hole 23 that reaches to the oil-fuel 7 is disposed at a bottom end of the curved slope 12*a* and 13*a*. Thus it becomes possible to discharge the oil 40. Furthermore, it is possible to securely discharge the oil 40 from the manifolds 12 and 13 by purging the manifolds with the purging air. Moreover, portions of the holes 17 and 18 that pass through the pilot nozzle 1 turn out to be circular convex portions 19*a* and 20*a*. Therefore, inner part of the manifolds 12 and 13 become circular surfaces and the oil 40 drips downward by way of the circular surfaces no matter what angles the manifolds 12 and 13 are mounted.

As explained above, the manifolds 12 and 13 are shaped so that no oil remains therein. To be more specific, the oil 40 in the manifolds 12 and 13 drips to the hole 23 that fixes the central pipe 8 of the main nozzle 2, and the hole 23 must be disposed therein. It is an example that the hole 23 is disposed at the lowest part of the manifolds 12 and 13. However, the present invention is viable as far as the oil is inducted to the hole 23 by means of gravity or purging air, regardless of the shape of the manifolds. As far as the manifolds 12 and 13 exert this function, the shapes of the manifolds 12 and 13 are not limited to the shapes shown in FIG. 3. In addition, the hole 23 does not have to be connected to the central pipe 8, and the hole 23 can be an exclusively purging hole if the hole 23 aims to remove the remaining oil 23.

Figure 4:
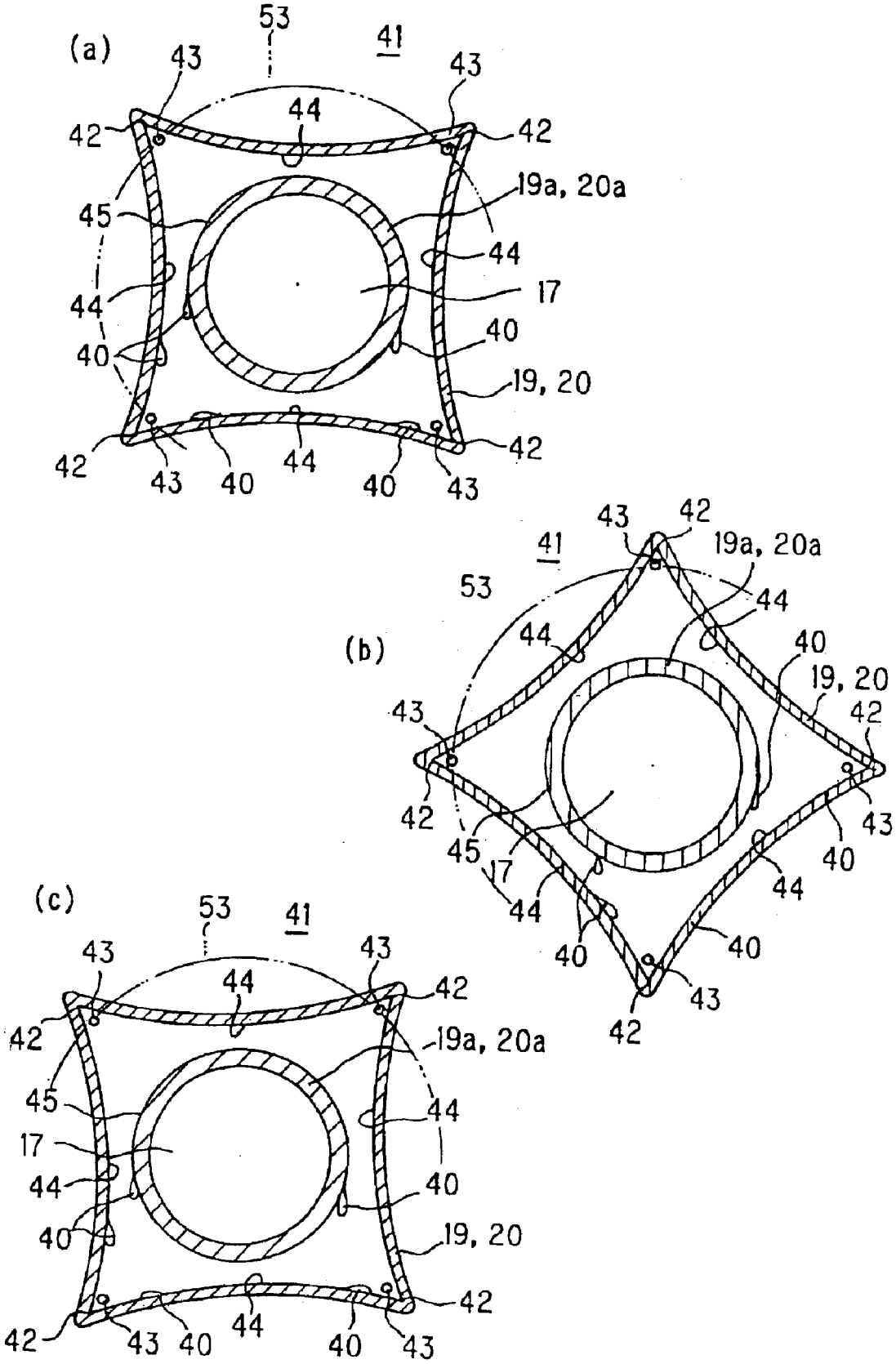
FIGS. 4A to 4C are explanatory drawings depicting a modification of a shape of manifold.

For the above mentioned purpose, the following shapes of the manifolds 12 and 13 are possible. FIGS. 4A to 4C are explanatory drawings that depicts modified shapes of the manifold. In the manifold 41, as shown in FIGS. 4A to 4C, the outer protruding portion 19 is rectangular in shape, and holes 43 are disposed in four corners 42. Each side of the manifold 41 is curved like a bow; a circular surface 45 is formed by a circular protruding portion 19*a* in the inside. Thus, no matter what angles the manifolds are mounted, inside a manifold 41 produces a curved slope 44, and the oil 40 is led to a hole 43. Namely, after the gas turbine is stopped or after the oil-fuel is switched to the gas-fuel, the oil remaining in the manifold 41 reaches the hole 43 by way of the curved slope 44.

Furthermore, preferably, by introducing the purging air into the manifold 41, the oil 40 in the manifold 41 is securely brought to the hole 43 and discharged out of the manifold 41. In addition, the oil 40 travels on the circular surface 45 and drips. The curved manifold 41 can be structured by changing shapes of the protruding portions 19 and 20 of the disk shaped members 14 and 15. In the structure mentioned above, regardless of angles the combustor 100 is mounted to, even in angles shown in FIGS. 4B and 4C, it is possible to discharge the oil 40 in the manifold 41 out of the hole 43.

Figure 5:
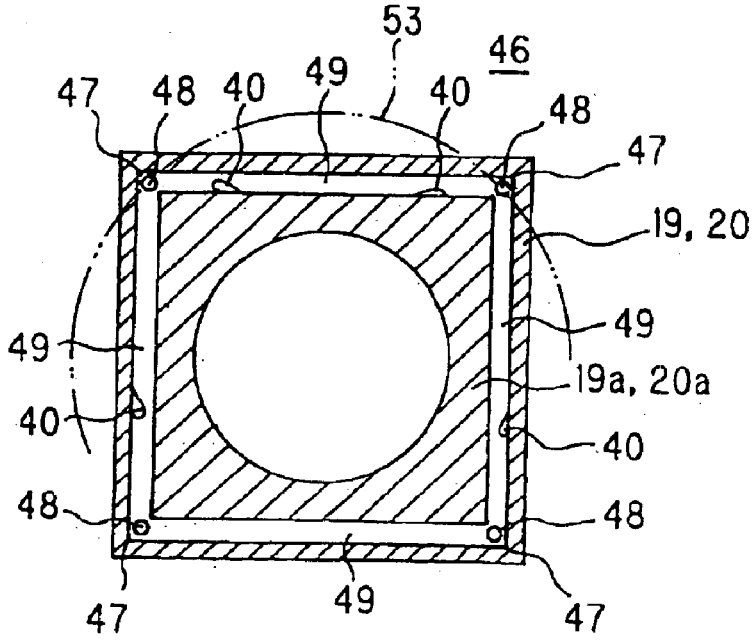
FIGS. 5A and 5B are explanatory drawings depicting another modification of a shape of manifold.
Figure 5:
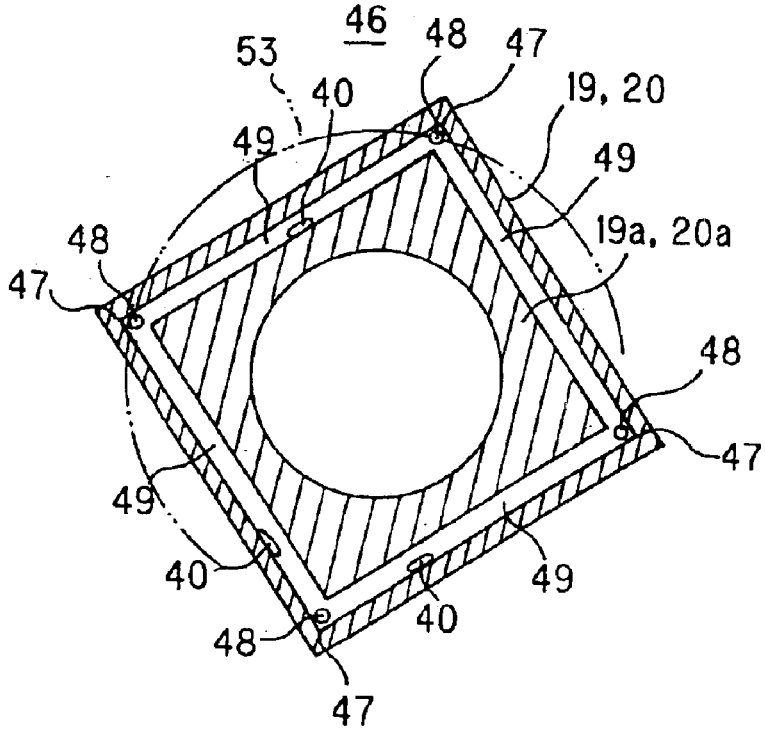
Figure 6:
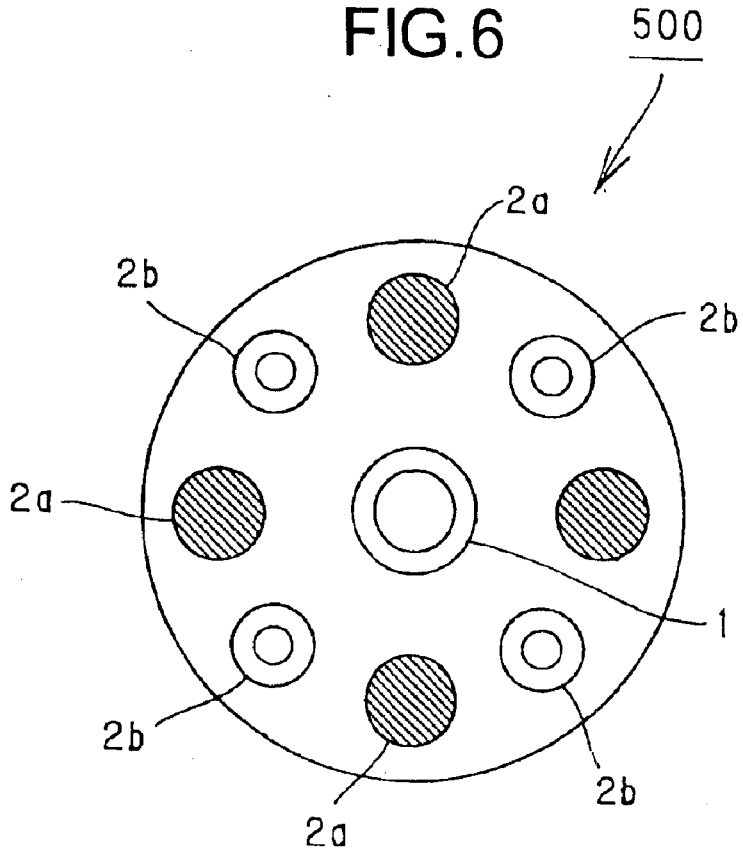
FIG. 6 is a front view of a nozzle of a combustor.
Figure 7:
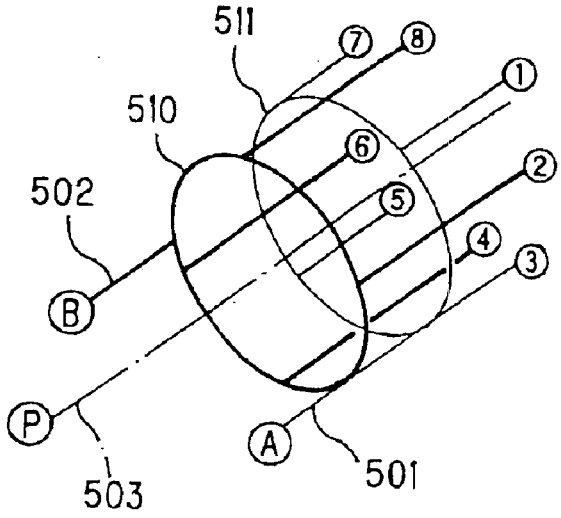
FIG. 7 is a schematic depicting the oil-fuel supply lines.
Figure 8:
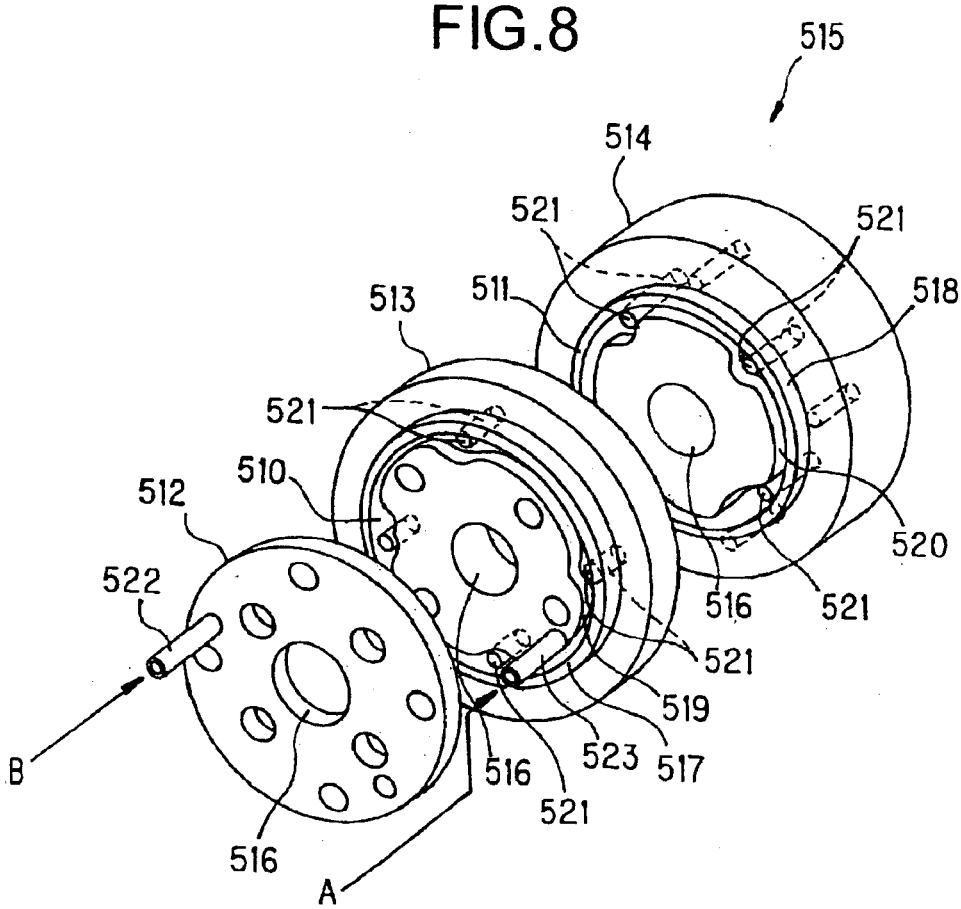
FIG. 8 is an assembly drawing of the nozzle of the combustor shown in FIG. 6.
Figure 9:
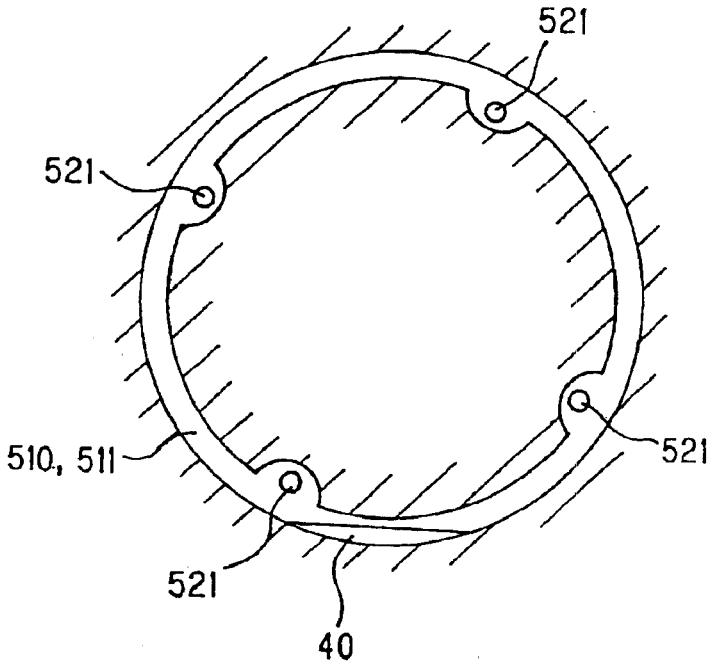
FIG. 9 is an explanatory drawing depicting a state of remaining oil in the nozzle of the combustor shown in FIG. 8.

FIGS. 5A and 5B are explanatory drawings depicting a shape of a manifold in an another embodiment. This manifold 46 consists of protruding portions 19, 20, 19*a*, and 20*a* being constructed square, and has holes 48 in four corners 47. As explained above, when the combustor 100 is mounted to the casing 101, the mounting angle is irrelevant to the shapes of the manifolds. In the case the manifold 46 is square in shape; the manifold 46 has a straight line portion 49. However, it is rare that the combustor 100 is mounted so that the straight line portion 49 becomes horizontal; instead, in most cases the straight line portion 49 is slanted as in FIG. 5B. Therefore, the oil 40 travels the slanted straight line portion 49 and the oil 40 is disposed from a hole 47. Moreover, it is possible to securely discharge the oil, by preferably introducing the purge air.

Even when the straight line portion 49 becomes almost horizontal as in FIG. 5A, by the purging air, it is easy to discharge the oil 40 which remains in the straight line portion 49, from the hole 48 because the oil does not remain in the curved potion as the conventional method. In contrast to the structure explained above, in the case of the conventional circular manifold, the hole almost never comes to the lowest position when the combustor is mounted to; as a result of this, the oil remains in the curved portion.

The manifolds 12, 13 (41, 46) have the holes 23 (42, 48), which are disposed inside the circumference 53 (indicated by a chain double-dashed line in FIGS. 3, 4, and 5) of the plurality of main nozzle 2 that are circumferentially disposed. Due to the structure mentioned above, it is possible to reduce the amount of oil that remains in the manifolds 12 and 13, therefore it is possible to prevent coking from occurring in the manifolds 12 and 13. Furthermore, it is possible to securely discharge the oil that remains in the manifolds 12 and 13 and securely prevent coking from occurring due to the remaining oil, in the case that the manifolds 12 and 13 are preferably formed inside the line 53*a* that links between the holes 23 (indicated by alternate long and short dashed lines in FIGS. 3A to 3C, 4A to 4C, 5A, and 5B), to be more preferable in the case that a mountain shape toward the center is formed between holes 23 (indicated by a symbol 50). Moreover, the oil 40 securely drips downward as the inner protruding portions 19*a* and 20*a* have circular surfaces (indicated by a symbol 51 in FIGS. 3A to 3C) regardless of the mounting angles.

Returning to FIG. 1, the heat insulation air layer 60, which is a closed space, is formed between the nozzle pipe stand 11 and the mounting sleeve 31 with the flange. The heat insulation air layer 60 is provided to avoid the heat transmitting directly to the manifold 12 and 13 from the flange 34 that directly contacts the casing 101. In an example shown in FIG. 1, the heat is insulated by a space 60*a* that is provided between a flange 31*a* of the mounting sleeve 30 and the nozzle pipe stand 11. In addition, the heat is insulated by providing a space 60*b* between the sleeve 31*b* of the sleeve 31 and the sleeve 30 of the pilot nozzle 1. In other words, the heat is insulated by making a heat path longer, the heat path thereof is from the mounting portion of the casing 101 to the manifold 12 and 13 by way of the sleeve 31*b*. Furthermore, the heat is insulated by providing a circular space 60*c* between the flange 34 and the nozzle pipe stand 11. The heat between the flange 34 and the nozzle pipe stand 11 is insulated by making the heat path between the flange 34 and the nozzle pipe stand 11 longer. To be more specific, it works well if the width of the heat insulation air layer 60 is around 7 millimeters or 8 millimeters.

The heat insulation air layer 60 effectively controls the heat transmitting from the casing 101 to the manifolds 12 and 13. Thus, the temperature inside the manifolds 12 and 13 can be kept low enough so that the oil does not cause coking. Moreover the shape of the heat insulation air layer 60 is not limited to the shape shown in FIG. 1. For example, a washer-shaped simple heat insulation air layer between the nozzle pipe stand 11 and sleeve 31 will do (not shown, corresponds to the space 60*a* only). The heat insulation air layer 60 may be filled with a heat insulation material to enhance the heat insulation so that coking is prevented from occurring.

If the heat insulation air layer 60 is efficient enough and able to maintain the temperature of the oil in the manifolds 12 and 13 low enough so that coking will not occur, the heat insulation air layer 60 can be applied to the combustor having the conventional circular manifold. In the embodiment explained above, the manifolds 12 and 13 became circular spaces as a hole was provided in the center of the nozzle pipe stand to mount the pilot nozzle. The manifolds 12 and 13 can be mere space, instead of circular space, if the hole for the pilot nozzle is not needed.

As explained above, the combustor according to the present invention includes the nozzle pipe stand that is mounted to the casing and has the plurality of main nozzles around the pilot nozzle. The nozzle pipe stand has the manifolds that branch the oil induction line to a plurality of the oil-fuel supply line of the main nozzles. The nozzle pipe stand has the heat insulating portion between the portion thereof is mounted to the casing and the manifolds, thus even if there is the remaining oil in the manifolds, the oil can be prevented from coking.

Moreover, the combustor includes the nozzle pipe stand that has the plurality of main nozzles around the pilot nozzle. The nozzle pipe stand has the flange that is to be mounted to the casing at the outer circumference thereof, and also has the manifolds that branch the oil-fuel induction line to the plurality of the oil-fuel supply line of the main nozzles. The pilot nozzle passes through the sleeve that is provided in the center of the nozzle pipe stand. Meanwhile, the main nozzles are mounted to the sleeved mounting flange, and the end of the sleeve of the sleeved mounting flange is joined with a gap to the sleeve of the nozzle pipe stand. Furthermore, it is possible to prevent the remaining oil in the manifolds from coking because the heat insulation layer is formed by joining the circumference of the flange of the sleeved mounting flange.

Furthermore, the combustor includes the nozzle pipe stand that is mounted to the casing and has the plurality of main nozzles around the pilot nozzle. The nozzle pipe stand has the manifolds that branch the oil-fuel induction line to a plurality of the oil-fuel supply line of the main nozzles. In the manifolds, the open holes that reach the oil-fuel supply line are provided. No oil remains inside the manifolds and coking inside the manifolds is prevented from occurring because the manifolds are formed inside the circumference of allocated plurality of the main nozzles. Likewise, it is possible to securely discharge the oil from the manifolds and prevent coking from occurring due to the remaining oil, if the manifolds are mainly formed inside the lines that link the holes, or manifolds are formed mountain shaped toward the center in between the holes, or manifolds are formed cross star shaped having curved surfaces and the holes disposed in peripheries of four corners.

In the combustor according to the present invention, it is possible to securely purge the oil in the manifolds and securely prevent coking from occurring, because the combustor is provided with the purging unit to purge inside the manifolds by introducing air, water or other fluid into the manifolds.

In the combustor according to the present invention, the nozzle pipe stand has the heat insulating portion between the portion where the nozzle pipe stand is mounted to the casing and the manifold. Thus, even if a very small amount of oil is remaining in the manifolds, the nozzle does not cause blockade despite the use of a long period time, because the heat insulating portion prevents the oil from coking.

Industrial Applicability

The combustor for the gas turbine of the present invention is useful for preventing coking in the manifolds that branch the pipes for the oil-fuel that is provided in the nozzle pipe stand. The combustor is suitable for preventing blockade of the nozzle that emits the oil-fuel.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A combustor for a gas turbine comprising:

a nozzle pipe stand having a plurality of main nozzles around a pilot nozzle and mounted to a casing through a sleeved mounting flange;

a manifold that branches oil-fuel in an oil supply line to the main nozzles; and a heat insulating portion disposed between the sleeved mounting flange and the manifold, wherein said heat insulating portion comprises a closed air space.

2. A combustor for a gas turbine comprising:

a nozzle pipe stand having a plurality of main nozzles around a pilot nozzle and mounted to a casing;

a manifold that branches oil-fuel in an oil supply line to the main nozzles; and a sleeved mounting flange, which holds the main nozzles and is joined to the nozzle pipe stand; and a sleeve through which the pilot nozzle passes is joined to an end of the sleeved mounting flange with a closed air gap formed between said sleeve and said sleeved mounting flange.

3. A combustor for a gas turbine comprising:

a nozzle pipe stand having a plurality of main nozzles around a pilot nozzle and mounted to a casing through a sleeved mounting flange; and a manifold having a plurality of holes bored on a first imaginary circle to branch oil-fuel in an oil supply line to the main nozzles, wherein the manifold has concave portions protruding inwardly.

4. The combustor according to claim 3, wherein the manifold is mainly formed in a center side of the first circle than on straight lines that link the neighboring holes.

5. The combustor according to claim 3, wherein the manifold is mountain shaped toward the center side of the first circle between the neighboring holes.

6. The combustor according to claim 3, wherein the manifold is cross star shaped being formed by curved surfaces, and the holes are bored on four corners of the manifold.

7. The combustor according to claim 3, wherein the manifold includes a circular space being formed in the nozzle pipe stand, inner surfaces of the manifold are curved.

8. The combustor according to claim 3, further comprising a purging unit to purge inside the manifold.

9. The combustor according to claim 3, further comprising a heat insulating portion in between the sleeved mounting flange and the manifold, wherein said heat insulating portion comprises a closed air space.

* * * * *